US005350248A

United States Patent [19]

Chen

[11] Patent Number: 5,350,248

[45] Date of Patent: Sep. 27, 1994

[54] TOOTHBRUSH WITH EXTENDIBLE BRUSHING ELEMENT

[76] Inventor: Anselm V. K. Chen, 46 Rockview Estate, Kuching, Sarawak, Malaysia, 93200

[21] Appl. No.: 170,820

[22] Filed: Dec. 21, 1993

[51] Int. Cl.[5] ..... B43K 29/00; A46B 9/04

[52] U.S. Cl. ..... 401/195; 401/145; 401/158; 401/161; 401/169; 15/167.1; 15/184; 15/172; 15/201

[58] Field of Search ..... 15/172, 186, 201, 167.1, 15/167.2, 204, 184, 185, 169, 203, DIG. 5, 123; 132/308, 212, 119; 128/62 A; 401/195, 145, 158, 161, 169

[56] References Cited

U.S. PATENT DOCUMENTS

| | | | |
|---|---|---|---|
| 2,111,880 | 3/1938 | Waters | 15/172 |
| 2,629,122 | 2/1953 | Den Uyl | 15/172 |
| 4,226,251 | 10/1980 | Wall | 132/119 |
| 4,574,416 | 3/1986 | Stewart et al. | 15/184 |
| 4,977,909 | 12/1990 | Chou | 15/184 |
| 4,988,228 | 1/1991 | Yeh | 15/184 |

*Primary Examiner*—Timothy F. Simone
*Assistant Examiner*—Gary K. Graham
*Attorney, Agent, or Firm*—Hugh E. Smith

[57] ABSTRACT

The present invention relates to a toothbrush having a handle portion including a first end and a second end. The toothbrush further includes a hollow forward portion, an aperture formed through the hollow forward portion, and a spring element having a first end and a second end. The first end of the spring element is secured to the hollow forward portion, and the second end of the spring element is positioned adjacent the aperture of the hollow forward portion. A bristled element is positioned within the aperture of the hollow forward portion, with the bristled element being connected to the second end of the spring element. An actuation element is included within the forward portion of the toothbrush. The actuation element has a first end and a second end, and a finger engaging surface positioned at the first end of the actuation element. The second end of the actuation element is adapted to ride along the spring element, with movement of the finger engaging element serving to move the second end of the actuation element along the length of the spring. The movement of the second end of the actuation element along the spring serves to bias the bristled element out through the aperture of the hollow forward portion. A forward portion cover is dimensioned to fit over the forward portion. A slot is formed within the forward portion cover. The slot is dimensioned and positioned to allow the finger engaging element to extend through it.

3 Claims, 4 Drawing Sheets

TOOTHBRUSH WITH EXTENDIBLE BRUSHING ELEMENT

BACKGROUND OF THE INVENTION

1. Field of the Invention

The present invention relates to a toothbrush and more particularly pertains to a toothbrush dimensioned and designed to clean the hard to reach areas of the mouth.

2. Description of the Prior Art

The use of toothbrushes is known in the prior art. More specifically, toothbrushes heretofore devised and utilized for the purpose of cleaning teeth are known to consist basically of familiar, expected, and obvious structural configurations, notwithstanding the myriad of designs encompassed by the crowded prior art which has been developed for the fulfillment of countless objectives and requirements.

For example U.S. Pat. No. 5,142,726 to Mann, and U.S. Pat. Nos. 4,152,806 and 4,149,293 to Raaf all disclose toothbrushes with pivotal or movable, members which enable the operator to adjust the bristle length.

U.S. Pat. No. 4,449,266 to Northemann discloses a toothbrush with two segments of bristles. The bristle bearing segments have mutually facing inside surfaces sloping towards each other.

Furthermore, U.S. Pat. No. 4,691,405 to Reed discloses a toothbrush having adjustable bristle-mounted tabs.

In this respect, the toothbrush according to the present invention substantially departs from the conventional concepts and designs of the prior art, and in doing so provides an apparatus primarily developed for the purpose of cleaning the hard to reach areas of the mouth.

Therefore, it can be appreciated that there exists a continuing need for new and improved toothbrushes which can be used for cleaning the hard to reach areas of the mouth. In this regard, the present invention substantially fulfills this need.

SUMMARY OF THE INVENTION

In view of the foregoing disadvantages inherent in the known types of toothbrushes now present in the prior art, the present invention provides an improved toothbrush. As such, the general purpose of the present invention, which will be described subsequently in greater detail, is to provide a new and improved toothbrush and method which has all the advantages of the prior art and none of the disadvantages.

To attain this, the present invention essentially comprises a new and improved toothbrush comprising a handle portion having a first end and a second end. A hollow forward portion has a first extent, a second extent, and a third extent. The first extent is integral with the handle portion and has a width which is smaller than the width of the handle portion. The second extent has a first end integral with the first extent, and a second end which is integral with the third extent. The second extent has a width which tapers from its first end to its second end. The width of first end of the second extent is greater than the width of the first extent, and the width of the second end of the second extent is substantially the same as the width of the first extent. An aperture is formed through the third extent of the forward portion. A spring element has a first end and a second end, the first end of the spring element is secured to the hollow forward portion approximate the first end of the second extent. The second end of the spring element is positioned adjacent the aperture of the hollow forward portion. A bristled element is positioned within the aperture of the third extent of the hollow forward portion. The bristled element is connected to the second end of the spring element. An actuation element has a first end and a second end, a finger engaging surface positioned at the first end of the actuation element. The finger engaging surface is positioned within the first extent of the hollow forward portion. The second end of the actuation element is adapted to ride along the spring element, with movement of the finger engaging element serving to move the second end of the actuation element along the length of the spring. The movement of the second end of the actuation element along the spring serves to bias the bristled element out through the aperture of the hollow forward portion. A forward portion cover dimensioned to fit over the first, second and third extents of the forward portion. A slot is formed within the forward portion cover, the slot dimensioned and positioned to allow the finger engaging element to extend through it.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved toothbrush which have all the advantages of the prior art toothbrushes and none of the disadvantages.

It is another object of the present invention to provide new and improved toothbrush which may be easily and efficiently manufactured and marketed.

It is further object of the present invention to provide new and improved toothbrush which are of durable and reliable constructions.

An even further object of the present invention is to provide new and improved toothbrush which are susceptible of a low cost of manufacture with regard to both materials and labor, and which accordingly are then susceptible of low prices of sale to the consuming public, thereby making such toothbrush economically available to the buying public.

Still yet another object of the present invention is to provide new and improved toothbrush which provide in the apparatuses and methods of the prior art some of the advantages thereof, while simultaneously overcoming some of the disadvantages normally associated therewith.

Even still another object of the present invention is to make a toothbrush which is designed to clean the hard to reach areas of the mouth.

Lastly, it is an object of the present invention to provide new and improved toothbrush having a handle portion including a first end and a second end. The toothbrush further includes a hollow forward portion, an aperture formed through the hollow forward portion, and a spring element having a first end and a second end. The first end of the spring element is secured to the hollow forward portion, and the second end of the spring element is positioned adjacent the aperture of the hollow forward portion. A bristled element is positioned within the aperture of the hollow forward portion, with the bristled element being connected to the second end of the spring element. An actuation element is included within the forward portion of the toothbrush. The actuation element has a first end and a second end, and a finger engaging surface positioned at the first end of the actuation element. The second end of the actuation element is adapted to ride along the spring element, with movement of the finger engaging element serving to move the second end of the actuation element along the length of the spring. The movement of the second end of the actuation element along the spring serves to bias the bristled element out through the aperture of the hollow forward portion. A forward portion cover is dimensioned to fit over the forward portion. A slot is formed within the forward portion cover. The slot is dimensioned and positioned to allow the finger engaging element to extend through it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
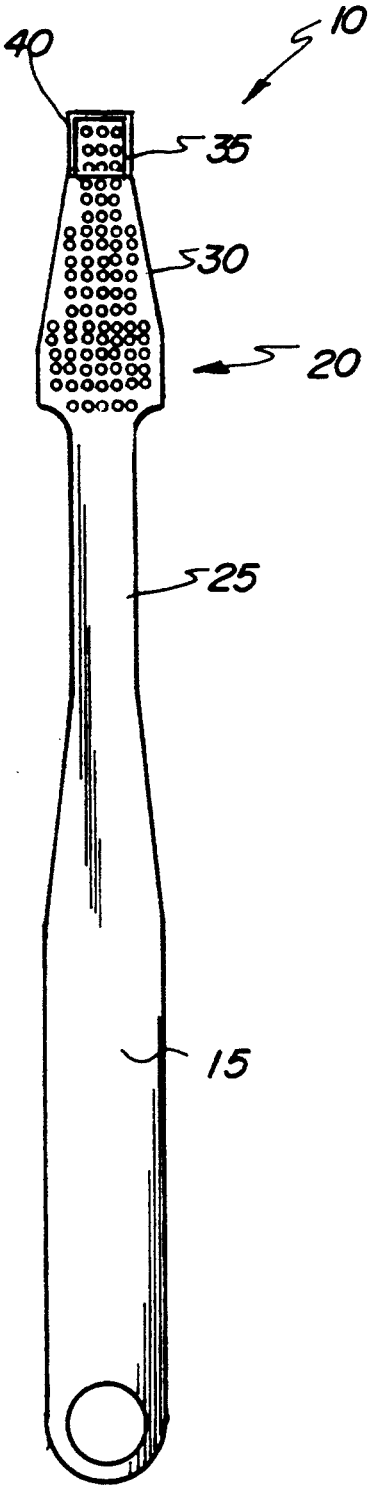
FIG. 1 is a plan view of the preferred embodiment of the toothbrush constructed in accordance with the principles of the present invention.
Figure 2:
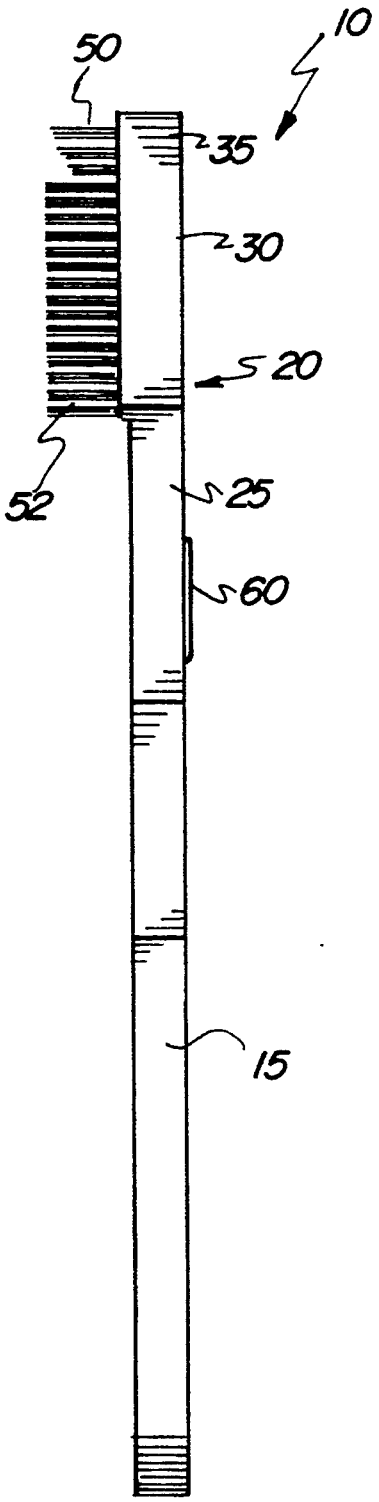
FIG. 2 is a side elevation view of the toothbrush in accordance with the first embodiment of the present invention.
Figure 3:
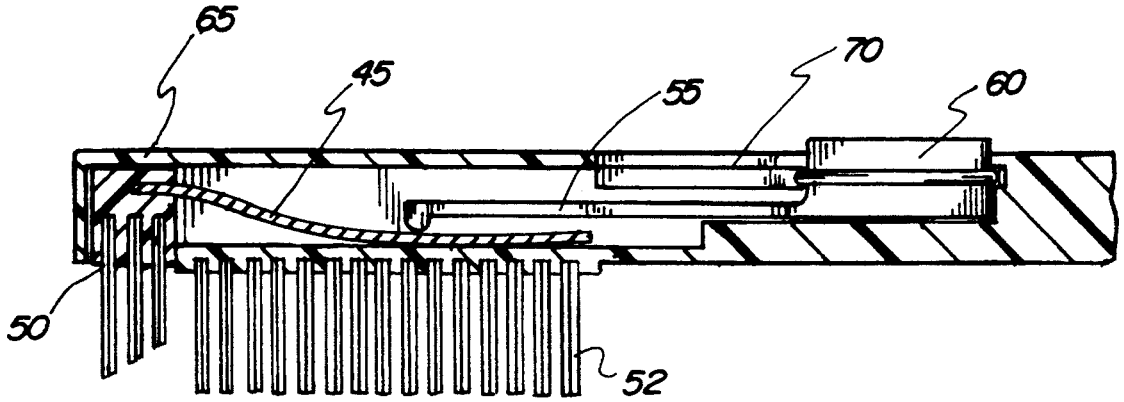
FIG. 3 is a sectional view of the forward portion of the toothbrush in accordance with the first embodiment of the present invention.
Figure 4:
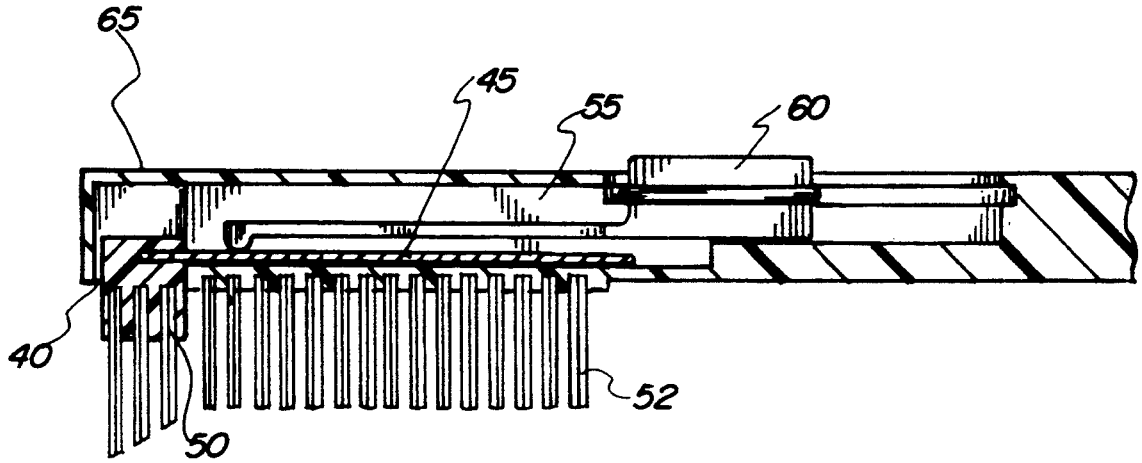
FIG. 4 is a sectional view of the forward portion of the toothbrush in accordance with the first embodiment of the present invention.
Figure 5:
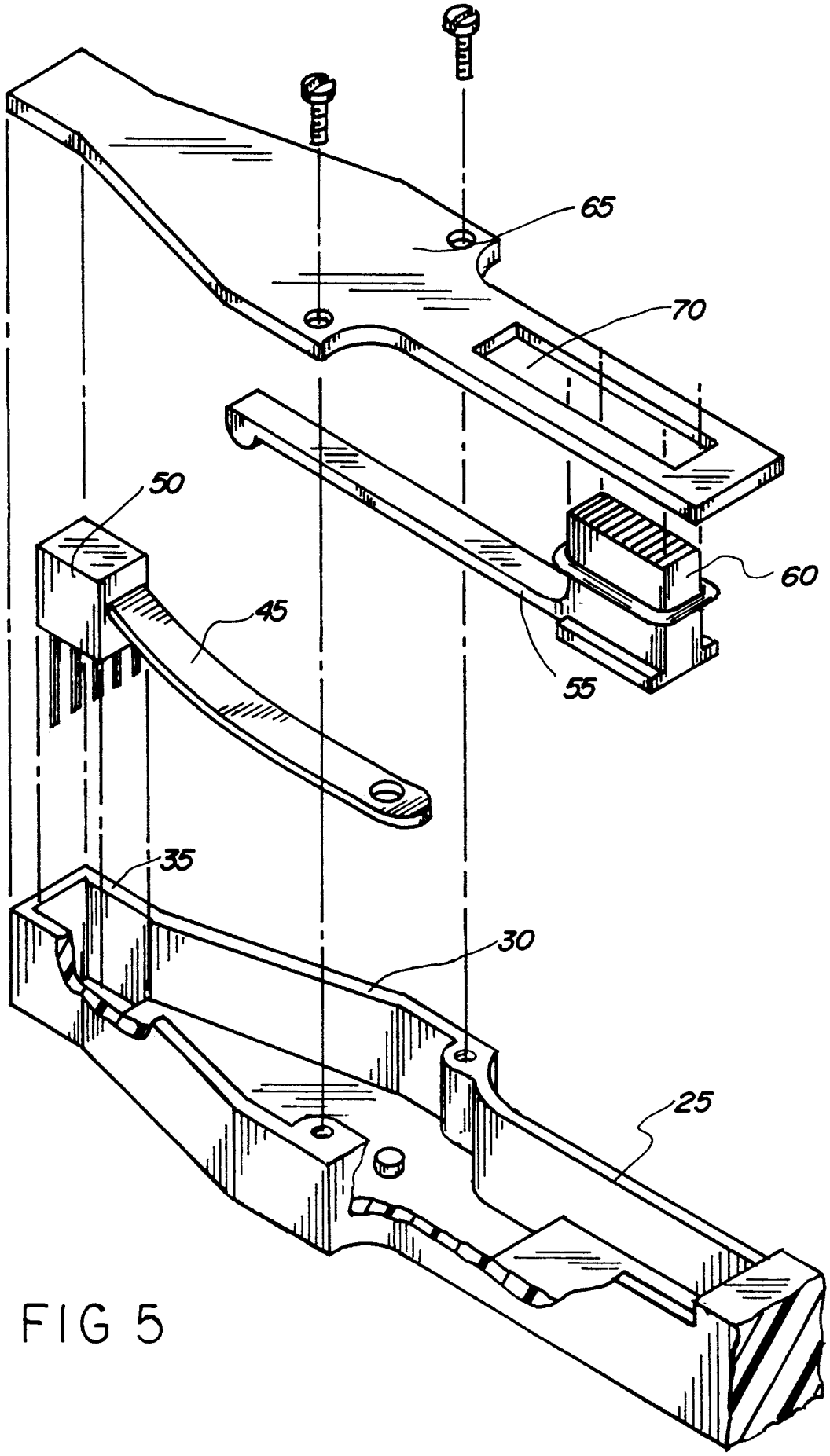
FIG. 5 is an exploded view of the forward portion of the toothbrush in accordance with the first embodiment of the present invention.

With reference now to the drawings, and in particular to FIG. 1 thereof, the preferred embodiment of the new and improved toothbrush embodying the principles and concepts of the present invention and generally designated by the reference numeral 10 will be described.

The present invention relates to a new and improved toothbrush 10. The toothbrush 10 of the present invention incorporates a head shape which enables it to clean hard to reach areas of the mouth. Furthermore, the toothbrush of the present invention employs a minor bristle section 50 which can be elevated relative to the main bristle section 52. The elevation of the minor bristle section 52 can be achieved by way of an activation mechanism. The entire toothbrush 10 can be constructed from a plastic, or alternatively, from a lightweight metal. The present invention will be more fully described hereafter.

As with conventional toothbrushes, the present toothbrush incorporates a handle portion 15 having a first end and a second end. The first end of the toothbrush can include a circular aperture to facilitate its storage. The only moving parts included in the toothbrush 10 are found in its hollow forward portion 20. The hollow forward portion 20 includes a first extent 25, a second extent 30, and a third extent 35.

The first extent 25 is integral with the handle portion 15 and has a width which is smaller than the width of the handle portion 15. The second extent 30 has a first end integral with the first extent 25, and a second end which is integral with the third extent 35. The second extent 30 has a width which tapers from its first end to its second end. The width of first end of the second extent 30 is greater than the width of the first extent 25, and the width of the second end of the second extent 30 is substantially the same as the width of the first extent 25. An aperture 40 is formed through the third extent 35 of the forward portion 20. Furthermore, the third extent 35 has a uniform width which is substantially the same as the width of the first extent 25. Thus, the forward portion 20 of the toothbrush 10 incorporates a unique tapered shape. This tapered shape enables the toothbrush 10 of the present invention to reach areas of the mouth that would be unreachable by conventional toothbrushes.

A spring element 45 which includes a first end and a second end is positioned within the forward hollow portion 20 of the toothbrush 10. The first end of the spring element 45 is secured to the hollow forward portion 20 approximate the first end of the second extent 30. The second end of the spring element 45 is positioned adjacent the aperture 40 of the hollow forward portion 20.

A minor bristled element 50 is positioned within the aperture 40 of the third extent 35 of the hollow forward portion 20. The minor bristled element 50 is positioned adjacent the major bristled portion 52 of the toothbrush 10. The minor bristled element 50 is connected to the second end of the spring element 45. The bristles of the minor bristled element 50 are tapered upwardly from the first end to the second end of the third extent 35. The dimensions of the minor element 50 and the configuration of its bristles are specifically configured for cleaning the hard to reach areas of the mouth.

The minor bristled element 50 can be moved relative to the forward portion 20 by way of an activation mechanism. The activation mechanism includes the spring element 45 and an actuation element 55. The actuation element 55 includes a first end and a second end. A finger engaging surface 60 is positioned at the first end of the actuation element 55. The finger engaging surface 60 is positioned within the first extent 25 of the hollow forward portion 20. The second end of the actuation element 55 is adapted to ride along the spring element 45. Movement of the finger engaging element 60 serves to move the second end of the actuation element 55 along the length of the spring 45. The movement of the second end of the actuation element 55 along the spring 45 serves to bias the bristled element 50 out through the aperture 40 of the hollow forward portion 20. Thus, an operator may selectively position the minor bristled element 50 relative to the forward portion 20 by manipulation of the finger engaging surface 60.

The hollow forward portion 20 is enclosed by way of a forward portion cover 65. The forward portion cover 65 is dimensioned to fit over the first 25, second 30 and third extents 35 of the forward portion 20. A slot 70 is formed within the forward portion cover 65 in the area of the third extent 35. The slot 70 is specifically dimensioned and positioned to allow the finger engaging element 60 to extend through it. The forward portion cover 65 is secured to the forward portion 20 by way of screws. However, the securement between the cover and forward portion can be achieved through other means such as glue or cement.

Figures 6, 7, 8:
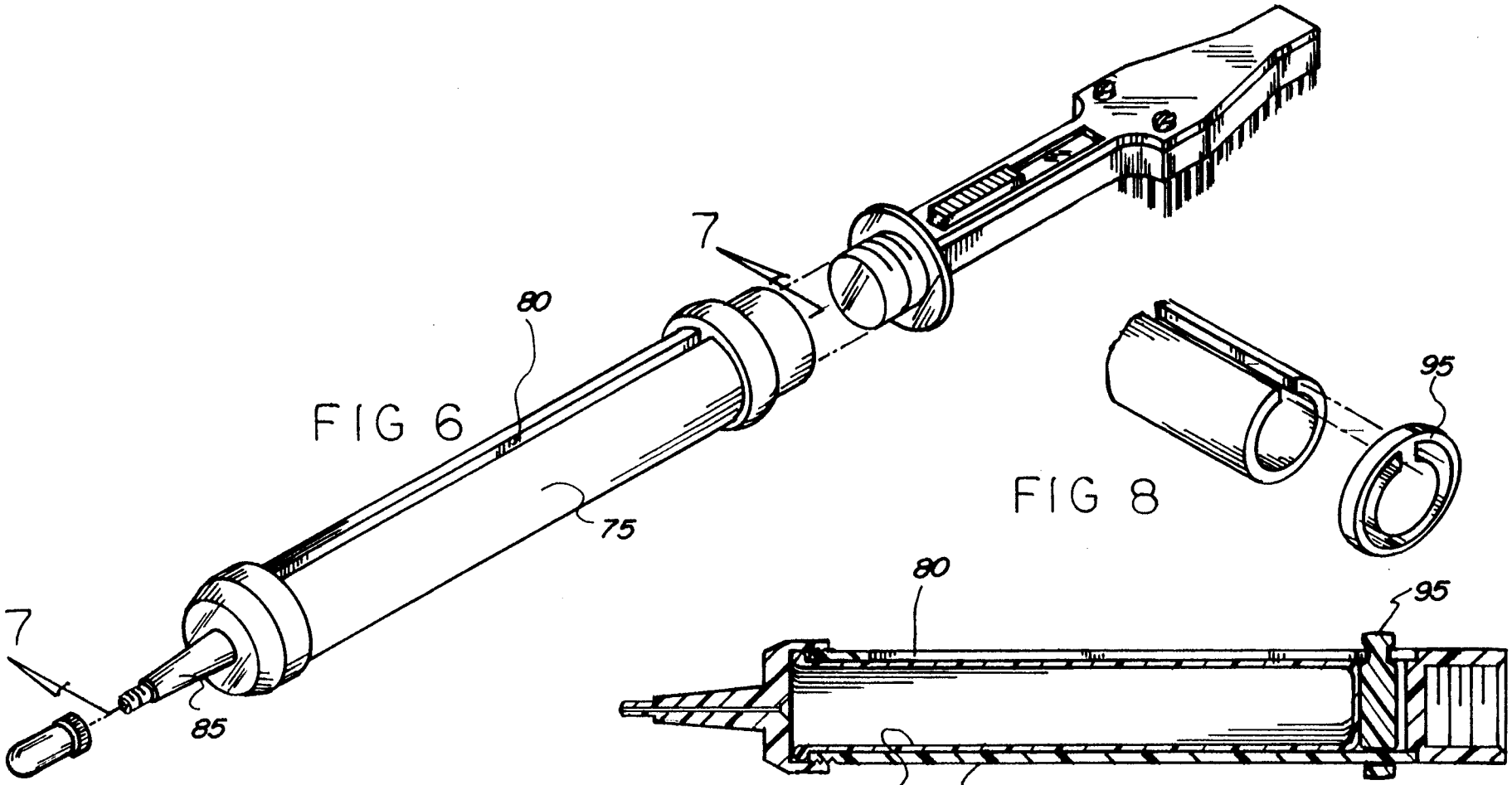
FIG. 6 is a perspective view of the toothbrush in accordance with the second embodiment of the present invention.
FIG. 7 is a sectional view of the cylindrical container in accordance with the second embodiment of the present invention.
FIG. 8 is a view of the piston in accordance with the second embodiment of the present invention.

The second embodiment of the present invention is substantially the same as the first. Note FIGS. 6 through 8. However, the second embodiment incorporates a mouthwash injection system in the handle. As with the first embodiment, the handle of the second embodiment includes a first and a second end. Additionally, the second embodiment incorporates a hollow cylindrical container 75 in the handle portion. The hollow cylindrical container 75 has a first end, a second end, and a slot 80 extending from the first to the second end. A dispensing nozzle 85 is positioned upon the second end of the handle portion. The dispensing nozzle 85 is in fluid communication with a flexible bladder 90 which is positioned within the hollow cylindrical container 75. The bladder 90 is designed to contain mouthwash or other oral cleansing fluid. The mouthwash is compressed out of the bladder 90 and though the nozzle 85 by way of a piston 95. The piston 95 is positioned within the hollow container 75 and within the slot 80 of the hollow container 75.

The present invention is a uniquely improved toothbrush which affords the user the advantages of controlled maneuverability and, as the name suggests, better access to the rear teeth and all other areas of the mouth. It is broadly conventional in classic shape with an elongated handle and bristles at the business end. However, the innovation in this idea is in the shape of the tip and the moveable bristles in this area. The end of the toothbrush of the present invention is tapered down to a narrower width so that it may easily be maneuvered into the smaller areas at the back of the mouth. In addition, the bristles at this narrowed tip are embedded in a moveable platform which is mounted on an angularly oriented leaf spring. The spring is anchored just above the handle end of the stationary bristles, and a button on a sliding member contained within the handle comes into contact with the top surface of the spring approximately midway along its length.

Hence, as this sliding member is pushed forward, the spring is forces downward along with the bristle bearing platform. the result is that the tip bristles now extend beyond their stationary counterparts and may be maneuvered and inserted into areas which were theretofore inaccessible. When the slide is retracted, the tip bristles are returned to a level that is flush with the other bristles, and the toothbrush may be used in a conventional fashion in the frontal area of the mouth.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toothbrush comprising in combination:

an elongated handle portion having a first end and a second end and having a width;

an elongated, hollow forward portion having a first extent, a second extent, and a third extent, the first extent being integral with the handle portion and having a width which is smaller than the width of the handle portion, the second extent having a first end integral with the first extent and a second end which is integral with the third extent, the second extent having a width which tapers from its first end to its second end, the width of first end of the second extent being greater than the width of the first extent, and the width of the second end of the second extent being substantially the same as the width of the first extent, an aperture formed through the third extent of the forward portion;

an elongated, curved spring element having a first end and a second end, the first end of the spring element being fixed to and within the hollow forward portion proximate the first end of the second extent, the second end of the spring element being positioned adjacent the aperture of the hollow forward portion;

a bristled element positioned within the aperture of the third extent of the hollow forward portion, the bristled element being fixed to the second end of the spring element, the spring element normally biasing said bristled element down into the aperture within the hollow portion;

an elongated actuation element mounted in said elongated hollow forward portion for longitudinal sliding movement along the length of said elongated hollow forward portion, said elongated actuating element having a first end and a second end, a finger engaging surface positioned at the first end of the actuation element, the finger engaging surface being positioned within the first extent of the hollow forward portion, the second end of the actuation element engaging the spring and being adapted to ride along the spring element in contact therewith, movement of the finger engaging element serving to move the second end of the actuation element along the length of the spring, the movement of the second end of the actuation element along the spring serving to straighten the spring element and move the bristled element out through the aperture of the hollow forward portion against the action of the spring;

a forward portion cover dimensioned to fit over the first, second and third extents of the forward portion, a slot formed within the forward portion cover, the finger engaging element extending through the slot.

2. A toothbrush comprising in combination:

an elongated handle portion having a first end and a second end;

an elongated, hollow forward portion, an aperture formed through the hollow forward portion;

an elongated, curved spring element having a first end and a second end, the first end of the spring element being fixed to and within the hollow forward portion, the second end of the spring element being positioned adjacent the aperture of the hollow forward portion;

a bristled element positioned within the aperture of the hollow forward portion, the bristled element being fixed to the second end of the spring element, the spring element normally biasing said bristled element down into the aperture within the elongated, hollow portion;

an elongated actuation element mounted in the elongated hollow forward portion for longitudinal sliding movement along the length of said elongated hollow forward portion, said elongated actuation element having a first end and a second end, a finger engaging surface positioned at the first end of the actuation element, the second end of the actuation element engaging the spring and being adapted to ride along the spring element in contact therewith, movement of the finger engaging element serving to move the second end of the actuation element along the length of the spring, the movement of the second end of the actuation element along the spring serving to straighten the spring and move the bristled element out through the aperture of the hollow forward portion against the action of said spring;

a forward portion cover dimensioned to fit over the forward portion, a slot formed within the forward portion cover, the finger engaging element extending through the slot.

3. The toothbrush as described in claim 2 wherein:

the handle portion is a hollow cylindrical container having a first end, a second end, a slot extending from the first to the second end of the container;

a dispensing nozzle positioned upon the second end of the handle portion;

a flexible bladder positioned within the hollow cylindrical container, the bladder being in fluid communication with the nozzle;

a piston positioned within the hollow container and within the slot of the hollow container, the piston serving to compress the bladder.

* * * * *